US006547888B1

(12) United States Patent
Williams et al.

(10) Patent No.: US 6,547,888 B1
(45) Date of Patent: Apr. 15, 2003

(54) MODIFIED LOW TEMPERATURE CASE HARDENING PROCESSES

(75) Inventors: Peter C. Williams, Cleveland Hts.; Steven V. Marx, University Heights, both of OH (US)

(73) Assignee: Swagelok Company, Solon, OH (US)

( * ) Notice: Subject to any disclaimer, the term of this patent is extended or adjusted under 35 U.S.C. 154(b) by 0 days.

(21) Appl. No.: 09/494,093

(22) Filed: Jan. 28, 2000

(51) Int. Cl.[7] ..... C23C 8/20; C23C 8/22

(52) U.S. Cl. ..... 148/206; 148/215; 148/216; 148/225

(58) Field of Search ..... 148/206, 215, 148/216, 225

(56) References Cited

U.S. PATENT DOCUMENTS

| | | | | |
|---|---|---|---|---|
| 1,923,814 A | | 8/1933 | Egan | 148/16 |
| 2,057,813 A | | 10/1936 | Babinet | 148/4 |
| 2,204,148 A | | 6/1940 | Nelms | 266/2 |
| 2,789,930 A | | 4/1957 | Engelhard | 148/16.6 |
| 2,851,387 A | | 9/1958 | Low | 148/16.6 |
| 4,268,323 A | | 5/1981 | Jakubowski et al. | 148/15.5 |
| 4,744,839 A | | 5/1988 | Queille | |
| 4,746,375 A | | 5/1988 | Iacovangelo | 148/20.3 |
| 4,975,147 A | | 12/1990 | Tahara et al. | 156/646 |
| 5,013,371 A | | 5/1991 | Tahara et al. | 148/16.6 |
| 5,139,584 A | * | 8/1992 | Gantois | 148/235 |
| 5,141,567 A | | 8/1992 | Tahara et al. | 148/271 |
| 5,194,097 A | | 3/1993 | Tahara et al. | 148/234 |
| 5,252,145 A | | 10/1993 | Tahara et al. | 148/206 |
| 5,254,181 A | | 10/1993 | Yoshino et al. | 148/231 |

(List continued on next page.)

FOREIGN PATENT DOCUMENTS

| | | | |
|---|---|---|---|
| DE | 19644153 A | | 4/1998 |
| EP | 0 080 124 A | | 6/1983 |
| EP | 0054962 B1 | | 4/1985 |
| EP | 0147011 A2 | | 7/1985 |
| EP | 0421236 B1 | | 5/1993 |
| EP | 0408168 B1 | | 6/1994 |
| EP | 0303191 B1 | | 12/1994 |
| EP | 0678589 A1 | | 10/1995 |
| EP | 0532386 B1 | | 4/1996 |
| EP | 0787817 A2 | | 8/1997 |
| EP | 0551702 B1 | | 6/1998 |
| FR | 1531285 A | | 11/1968 |
| FR | 2 656 003 A | | 6/1991 |
| FR | 2722212 A1 | | 7/1995 |
| GB | 421014 A | | 12/1934 |
| GB | 837932 A | | 6/1960 |
| JP | 62-227074 | * | 10/1987 |
| SU | 1666573 A1 | | 7/1991 |
| SU | 1678896 A1 | | 9/1991 |
| SU | 1752828 A1 | | 8/1992 |

OTHER PUBLICATIONS

Japanese Abstract of Publication No. 04128361A, published Apr. 28, 1992.
Japanese Abstract of Publication No. 06010242A, published Jan. 18, 1994.
Japanese Abstract of Publication No. 60067651A, published Apr. 18, 1985.
English translation of Japanese Laid–Open (Kokai) Publication No. 10–18017.

(List continued on next page.)

*Primary Examiner*—Roy King
*Assistant Examiner*—Nichole Gay
(74) *Attorney, Agent, or Firm*—Calfee, Halter & Griswold, LLP

(57) ABSTRACT

An iron-containing workpiece is case hardened by low temperature carburization during which one or more process steps—including adjusting the carburization temperature, adjusting the concentration of carburization specie in the carburization gas and reactivating the surfaces to be carburized—is carried out to enhance the overall rate and uniformity of carburization with minimized soot generation, whereby carburization can be completed faster than possible in the past.

60 Claims, 3 Drawing Sheets

U.S. PATENT DOCUMENTS

| | | | | |
|---|---|---|---|---|
| 5,340,412 | A | 8/1994 | Yoshino et al. | 148/208 |
| 5,376,188 | A | 12/1994 | Tahara et al. | 148/230 |
| 5,424,028 | A | 6/1995 | Maloney et al. | 148/319 |
| 5,447,181 | A | 9/1995 | Tahara et al. | 148/206 |
| 5,593,510 | A | 1/1997 | Taraha et al. | 148/225 |
| 5,650,022 | A | 7/1997 | Kitano et al. | 148/228 |
| 5,653,822 | A | 8/1997 | Stickels et al. | 148/220 |
| 5,792,282 | A | 8/1998 | Tahara et al. | 148/206 |
| 6,165,597 | A | * 12/2000 | Williams et al. | 148/213 |

OTHER PUBLICATIONS

English translation of Japanese Laid–Open (Kokai) Publication No. 6–228732.

"The corrosion behavior of chromium in hydrogen chloride gas and gas mixtures of hydrogen chloride and oxygen at high temperatures," *Corrosion Science*, vol. 23(2) (1983), pp. 167–181.

Lewis et al., "Metallurgical Study of Low–Temperature Plasma Carbon Diffusion Treatments for Stainless Steels," *Surface and Coating Technology*, vol. 60, 1993.

Stevenson et al., "The Effect of Process Parameters on the Plasma Carbon Diffusion Treatment of Stainless Steels at Low Pressure," vol. 63, 1994.

J.P. Millet et al., "Corrosion Behaviour of 316L Stainless Steel in a Chloride Medium and in Contact with Active Carbon," 1988 Conference, Nace, Houston, Texas, pp. 45–53.

* cited by examiner

MODIFIED LOW TEMPERATURE CASE HARDENING PROCESSES

TECHNICAL FIELD OF THE INVENTION

The present invention relates to case hardening iron-based articles substantially without formation of carbides.

BACKGROUND OF THE INVENTION

Case hardening is a widely used industrial process for enhancing the surface hardness of metal articles. In a typical commercial process, the workpiece is contacted with a carburizing gas at elevated temperature whereby carbon atoms diffuse into the article surface. Hardening occurs through the formation of carbide precipitates, generally referred to simply as "carbides". Gas carburization is normally accomplished at 1700° F. (950° C.) or above, since most steels need to be heated to these temperatures to convert their phase structures to austenite, which is necessary for carbon diffusion. In general. see Stickels., "Gas Carburizing",pp 312 to 324, Volume 4, ASM handbook copyright 1991, ASM International.

Carbide precipitates not only enhance surface hardness, they also promote corrosion. For this reason, stainless steel is rarely case hardened by conventional gas carburization, since the "stainless" quality of the steel is compromised.

In our earlier application Ser. No. 9/133,040, filed Aug. 12, 1998, now U.S. Pat. No. 6,093,310 we describe a technique for case hardening stainless steel in which the workpiece is gas carburized below 1000° F. At these temperatures, and provided that carburization does not last too long, the workpiece will carburize with little or no formation of carbide precipitates. As a result, the workpiece surface not only becomes hardened but also the inherent corrosion resistance of the stainless steel is maintained.

See, also. U.S. Pat. No. 5,792,282, EPO 0787817 and Japanese Patent Document 9-14019 (Kokai 9-268364).

Although low temperature gas carburization processes can achieve hardened stainless steel products with superior corrosion resistance, it is always desirable too improve such processes to achieve faster, more-economical operation.

Accordingly, it is an object of the present invention to provide a modified low temperature gas carburization process for case hardening stainless steel and other ferrous-based materials which allows faster carburization than possible in the past and thereby reduces the overall cost of such procedures.

SUMMARY OF THE INVENTION

This and other objects are accomplished by the present invention which is based on the discovery that the rate of workpiece carburization in a low temperature carburization process can be increased by adjusting the temperature of carburization and/or the concentration of the carburization specie in the carburizing gas to approach but not exceed predetermined limits which foster carbide precipitate formation.

Accordingly, the present invention provides a new process for low temperature gas carburizing a workpiece containing iron, nickel or both comprising contacting the workpiece with a carburizing gas at an elevated carburizing temperature sufficient to promote diffusion of carbon into the surfaces of the article but insufficient to promote substantial formation of carbide precipitates in the article surfaces, wherein the carburizing temperature is lowered from an initial carburizing temperature to a final carburizing temperature so as to achieve faster carburization than possible for carburization carried out at the final carburizing temperature only.

In addition, the present invention also provides a new process for low temperature gas carburizing a workpiece containing iron, nickel or both comprising contacting the workpiece with a carburizing gas at an elevated carburizing temperature sufficient to promote diffusion of carbon into the surfaces of the article but insufficient to promote substantial formation of carbide precipitates in the article surfaces, wherein the concentration of the carburizing specie in the carburizing gas is lowered from an initial concentration to a final concentration during carburization so as to achieve a harder case than possible for carburization carried out at the final concentration only and, in addition less soot generation than possible for carburization carried out at the initial concentration only.

Still further, the present invention also provides a new process for low temperature gas carburizing a stainless steel workpiece comprising activating the surfaces of the workpiece to be carburized to make these surfaces previous to carbon atoms and then contacting the workpiece with a carburizing gas at an elevated carburizing temperature sufficient to promote diffusion of carbon into the surfaces of the article but insufficient to promote substantial formation of carbide precipitates in the article surfaces, wherein after carburization is at least 10% complete as measured by the amount of carbon taken up by the workpiece surfaces but before carburization is 80% complete, carburization is interrupted and the workpiece is reactivated to enhance diffusion of carbon atoms into the workpiece surfaces.

In yet still another aspect, the present invention also provides a new process for case hardening a workpiece by gas carburization in which a workpiece electroplated with iron is contacted with a carburizing gas at an elevated carburization temperature to cause carbon to diffuse into the workpiece surfaces thereby forming a hardened case of predetermined thickness, wherein after carburization has started but before carburization is completed carburization is interrupted and the workpiece is contacted with a purging gas consisting essentially of an inert gas at a purging temperature below 600° F. so that the case formed at the end of carburization is harder than the case that would have been formed without contact with the purging gas.

BRIEF DESCRIPTION OF THE DRAWING

The present invention may be more readily understood by reference to the following drawings wherein FIG. 1 also illustrating how conventional low temperature carburization is carried out;

DETAILED DESCRIPTION

Figure 1:
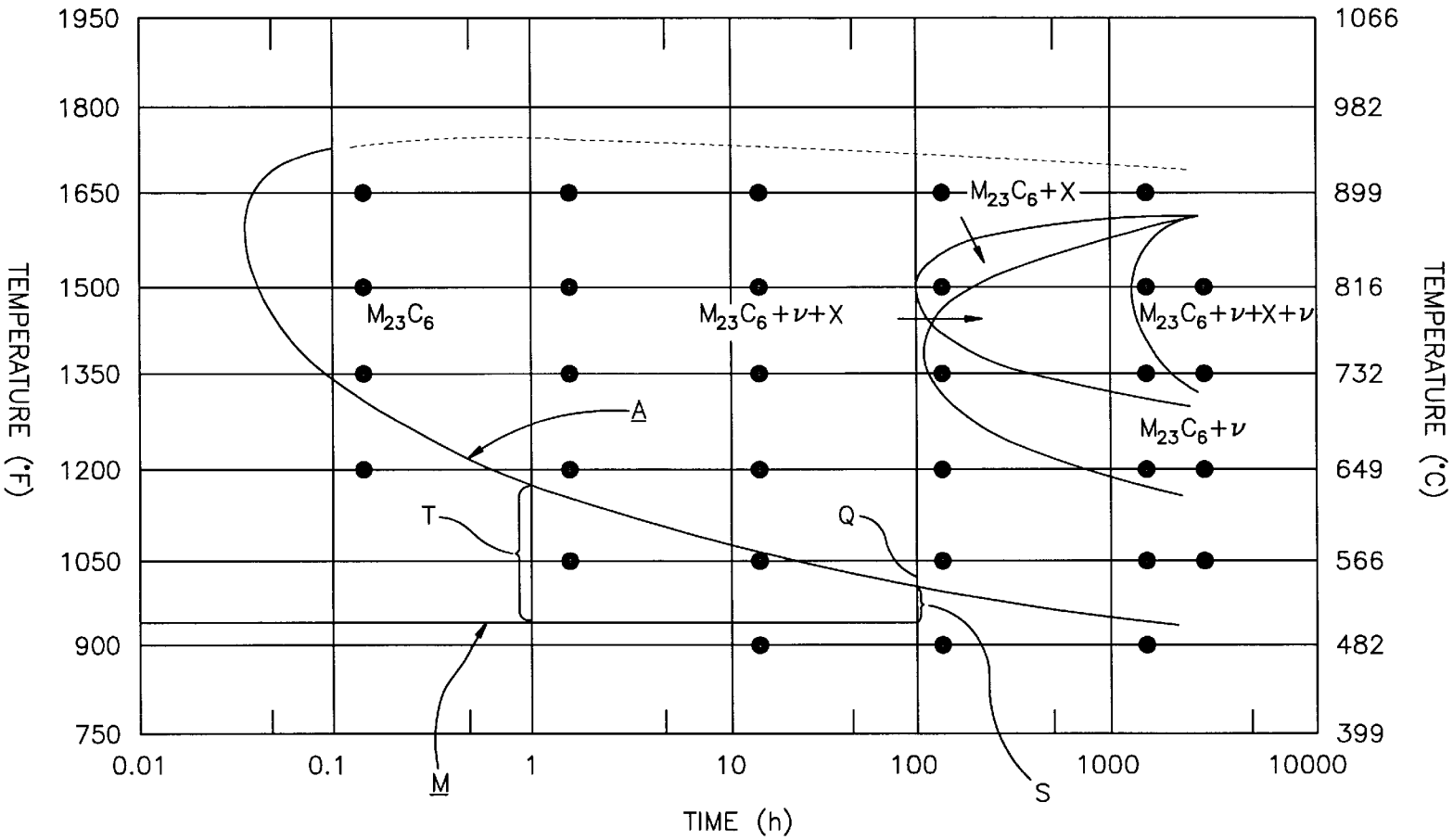
FIG. 1 is a phase diagram illustrating the conditions of time and temperature under which an AISI 316 stainless steel forms carbide precipitates.

In accordance with the present invention, an iron-containing workpiece is case hardened by low temperature carburization during which one or more process steps—including adjusting the carburization temperature, adjusting the concentration of carburization specie in the carburization gas, reactivating the surfaces to be carburized and cleaning the surfaces to be carburized—is carried out to enhance the overall rate of carburization and thereby complete the carburization process faster than possible in the past.

Workpiece

The present invention is applicable to case hardening any iron or nickel-containing material capable of forming a hardened surface or "case" by diffusion of carbon atoms into the surfaces of the material without formation of precipitates. Such materials are well known and described for example in the above-noted application Ser. No. 9/133,040, filed Aug. 12, 1998. U.S. Pat. No. 5,792,282 EPO 0787817 and Japanese Patent Document 9-14019 (Kokai 9-268364), the disclosures of which are incorporated herein by reference.

The present invention finds particular applicability in case hardening steels, especially steels containing 5 to 50, preferably 10 to 40, wt. % Ni. Preferred alloys contain 10 to 40 wt. % Ni and 10 to 35 wt. % Cr. More preferred are the stainless steels, especially the AISI 300 and 400 series steels. Of special interest are AISI 316, 316L, 317, 317L and 304 stainless steels, alloy 600, alloy C-276 and alloy 20 Cb, to name a few examples.

The present invention is also applicable to articles of any shape. Examples include pump components, gears, valves, spray nozzles, mixers, surgical instruments, medical implants, watch cases, bearings, connectors, fasteners, electronic filters, shafts for electronic equipment, splines, ferrules and the like.

Moreover, the present invention can be employed to case harden all the surfaces of the workpiece or only some of these surfaces, as desired.

Activation

Stainless steel, especially austenitic stainless steel, forms a coherent protective layer of chromium oxide ($Cr_2O_3$) essentially instantaneously upon exposure to the atmosphere. This chromium oxide layer is impervious to diffusion of carbon atoms. Accordingly, when the workpiece to be carburized in accordance with the present invention is a stainless steel or other material having a surface layer impervious to the diffusion of carbon atoms therethrough, the workpiece surfaces to be case hardened should be activated or "depassivated" before carburization.

Many techniques for activating stainless steel and other metal articles for fostering diffusion of carbon atoms therein are known. Examples include contacting the workpiece with a hydrogen halide gas such as HCI or HF at elevated temperature (e.g. 500 to 600° F), contact with a strong base, electroplating with iron, contact with liquid sodium and contact with a molten salt bath including sodium cyanide. These techniques are described, for example, in the above-noted application SN 9/133,040, filed Aug. 12, 1998, now U.S. Pat. No. 6,093,303 U.S. Pat. No. 5,792,282, EPO 0787817 and Japanese Patent Document 9-14019 (Kokai 9-268364). See also Stickles et al., "Heat Treating",pp 312, 314, Volume 4, ASM Handbook, copyright 1991, ASM International as well as U.S. Pat. No. 4,975,147, U.S. Pat. No. 5,372,655 and PCT/US99/18420, filed Aug. 12, 1999, the disclosures of which are also incorporated herein by reference.

Whether or not the workpiece to be carburized forms a protective passivating layer impervious to the diffusion of carbon atoms, it is beneficial to clean the surfaces to be carburized such as by contact with soapy water or an organic solvent such as acetone or mineral spirits before carburization (and before activation if required).

Low Temperature Carburization

Once the workpiece is ready for carburization, it is contacted with a carburizing gas at elevated temperature for a time sufficient to allow carbon atoms to diffuse into the workpiece surfaces.

In low temperature carburization, the carburizing gas is maintained at an elevated carburizing temperature which is high enough to promote diffusion of carbon atoms into the surfaces of the article but not so high that carbide precipitates form to any significant degree.

This may be more readily understood by reference to FIG. 1 which is a phase diagram of an AISI 316 stainless steel illustrating the conditions of time and temperature under which carbide precipitates form when the steel is carburized using a particular carburization gas. In particular, FIG. 1 shows, for example, that if the workpiece is heated within the envelope defined by Curve A, a metal carbide of the formula $M_{23}C_6$ will form. Thus, it will be appreciated that if the workpiece is heated under conditions of time and temperature falling anywhere above the lower half of Curve A, carbide precipitates will form in the workpiece surfaces. Therefore, low temperature carburization is carried out below curve A so that carbide precipitates do not form.

From FIG. 1 it can also be seen that, for a given carburizing gas, the carburization temperatures which promote formation of carbide precipitates vary as function of carburizing time. For example, FIG. 1 shows that at a carburization temperature of 1350° F., carbide precipitates begin forming after only one-tenth of an hour (6 minutes). On the other hand, at a carburization temperature of about 975° F., carbide precipitates do not begin forming until carburization has proceeded for 100 hours or so. Because of this phenomenon, low temperature carburization is normally carried out at a constant carburization temperature maintained below the temperature at which carbide precipitates form at the end of carburization. For example, for a low temperature carburization process anticipated to last 100 hours using the alloy and carburizing gas of FIG. 1, carburization would normally be carried out at a constant temperature of 925° F. or less, since this would maintain the workpiece safely below the temperature at which carbide precipitates form at the endpoint of carburization (i.e. 975° F). Or, as illustrated in FIG. 1, carburization would normally be done along line M, since this would keep the workpiece safely below point Q, so that carbide precipitates do not form.

Typical low temperature carburization processes can take 50 to 100 to 1000 hours or more to achieve the desired amount of carburization. Accordingly, it will be appreciated that when carburization is carried out at a constant temperature safely below point Q, the carburization temperature at any instantaneous time, t, during earlier phases of carburization will be far below Curve A. This is also illustrated in FIG. 1 in which line segment S represents the difference between the temperature of Curve A and the carburization temperature (925° F.) at the endpoint of carburization, while line segment T represents this difference one hour after carburization has begun. As can be seen by comparing line segments S and T, when the carburization temperature is maintained at a constant 925° F. so as to be at least 50° F. below point Q at the end of carburization, then there will be a 150° F. difference (1175° F.–925° F.) between the actual carburization temperature and Curve A one hour after carburization has begun. Since carburization rate depends on temperature, it can be seen that the relatively low carburization temperature of 925° F. during the early phases of carburization slows the overall carburization process carried out in this manner.

Adjustment of Carburization Temperature

In accordance with one aspect of the present invention, this constraint is largely eliminated by beginning the carburization process with a higher carburization temperature than typically used in the past and then lowering this temperature as carburization proceeds to reach a normal carburization temperature at the endpoint of the carburization process.

Figure 2:
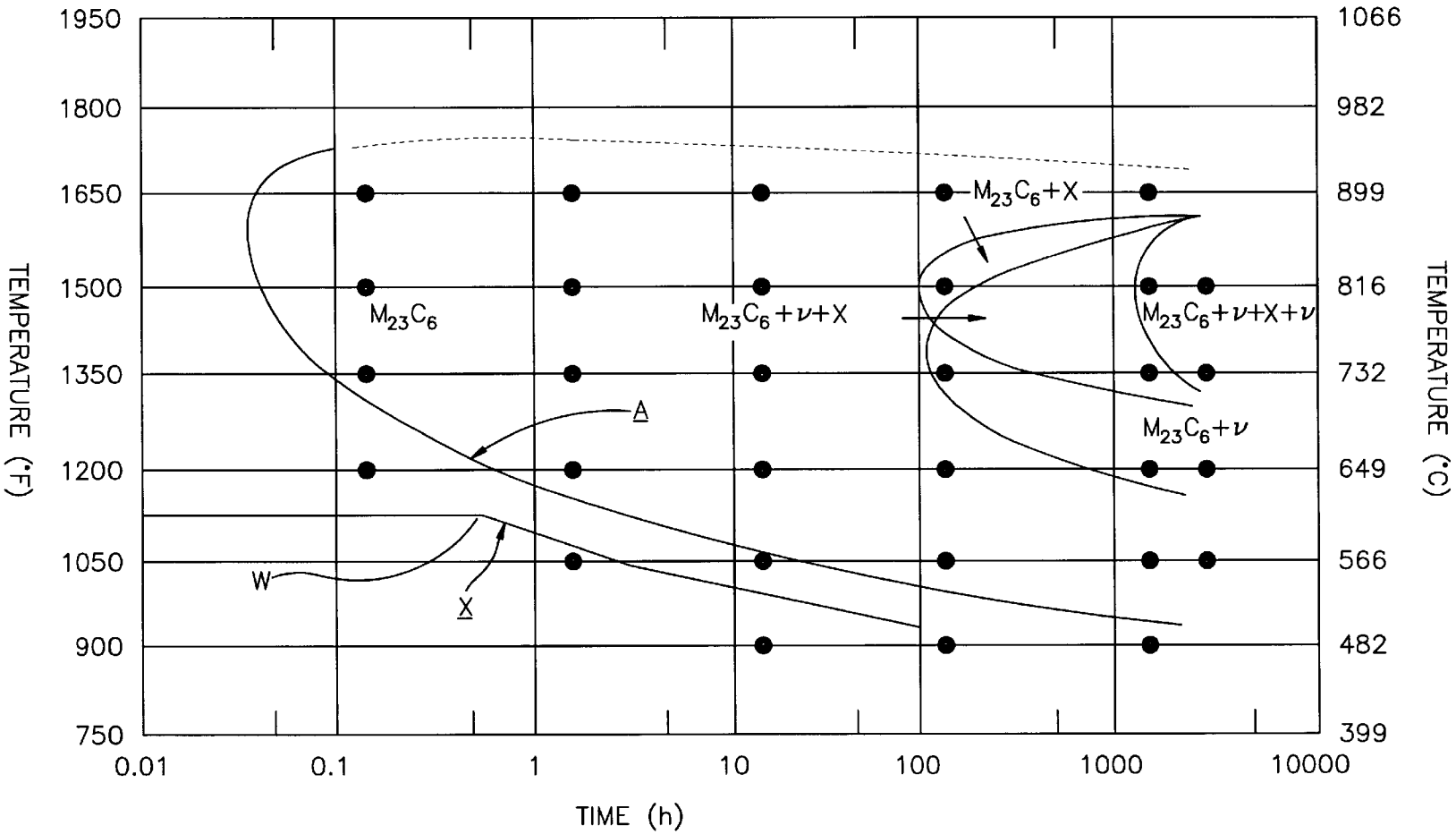
FIG. 2 is a phase diagram similar to FIG. 1 illustrating how low temperature carburization is carried out in accordance with one aspect of the present invention.

This approach is illustrated by Curve X in FIG. 2, which is similar to Curve M in FIG. 1, except that Curve X illustrates lowering the carburization temperature over the course of carburization from an initial high value to a lower final value. In particular Curve X shows starting carburization at an initial carburization temperature of 1125° F. which is about 50° F. less than the temperature at which carbide precipitates begin to form one-half hour into the carburization process (Point W of FIG. 2), and then lowering the carburization temperature as carburization proceeds to reach a final carburization temperature of 925° F. at the endpoint of carburization, the same endpoint temperature used in the conventional process as illustrated in FIG. 1.

In this particular embodiment, the carburization temperature at any time t during the carburization process is kept within a predetermined amount (e.g. 50° F., 75° F., 100° F., 150° F. or even 200° F.) of the temperature at which carbides just begin to form at that time. In other words, the carburization temperature is maintained below Curve A by a predetermined amount throughout the carburization process. By this means, the carburization temperature is kept considerably higher than in conventional practice yet below the temperatures at which carbide precipitates begin to form. The net effect of this approach is to increase the overall rate of carburization because, throughout most of the carburization process, the carburization temperature is higher than it would otherwise be. At any time t during carburization, the instantaneous rate of carburization depends on temperature, and the present invention in this approach increases this instantaneous rate by increasing the instantaneous carburization temperature. The net effect is a higher overall rate of carburization, which in turn leads to a shorter overall amount of time for completing the carburization process.

Of course, it is still necessary when operating at higher carburization temperatures as described above to insure that carbide precipitates do not form to any substantial degree during carburization. Accordingly, not only is the carburization temperature set so as not to drop below a minimum predetermined amount at any time t, as described above, but it is also set not to exceed a maximum value which is too close to Curve A. In other words, the carburization temperature must still be maintained a sufficient amount (e.g. 25° F. or 50° F.) below Curve A at any time t to insure that carbide precipitates are not formed. In actual practice, then, this means that the carburization temperature will be set within a range below Curve A whose maximum is a sufficient distance below Curve A (e.g. 25° F. or 50° F.) and whose minimum is further below Curve A by the predetermined amount mentioned above (i.e. 50° F. 75° F., 100° F., 150° F. or 200° F., for example). Thus, the carburization temperature will typically be set to reside within some suitable range (e.g. 25° F. to 200° F. or 50° F. to 100° F.) below Curve A.

Figure 3:
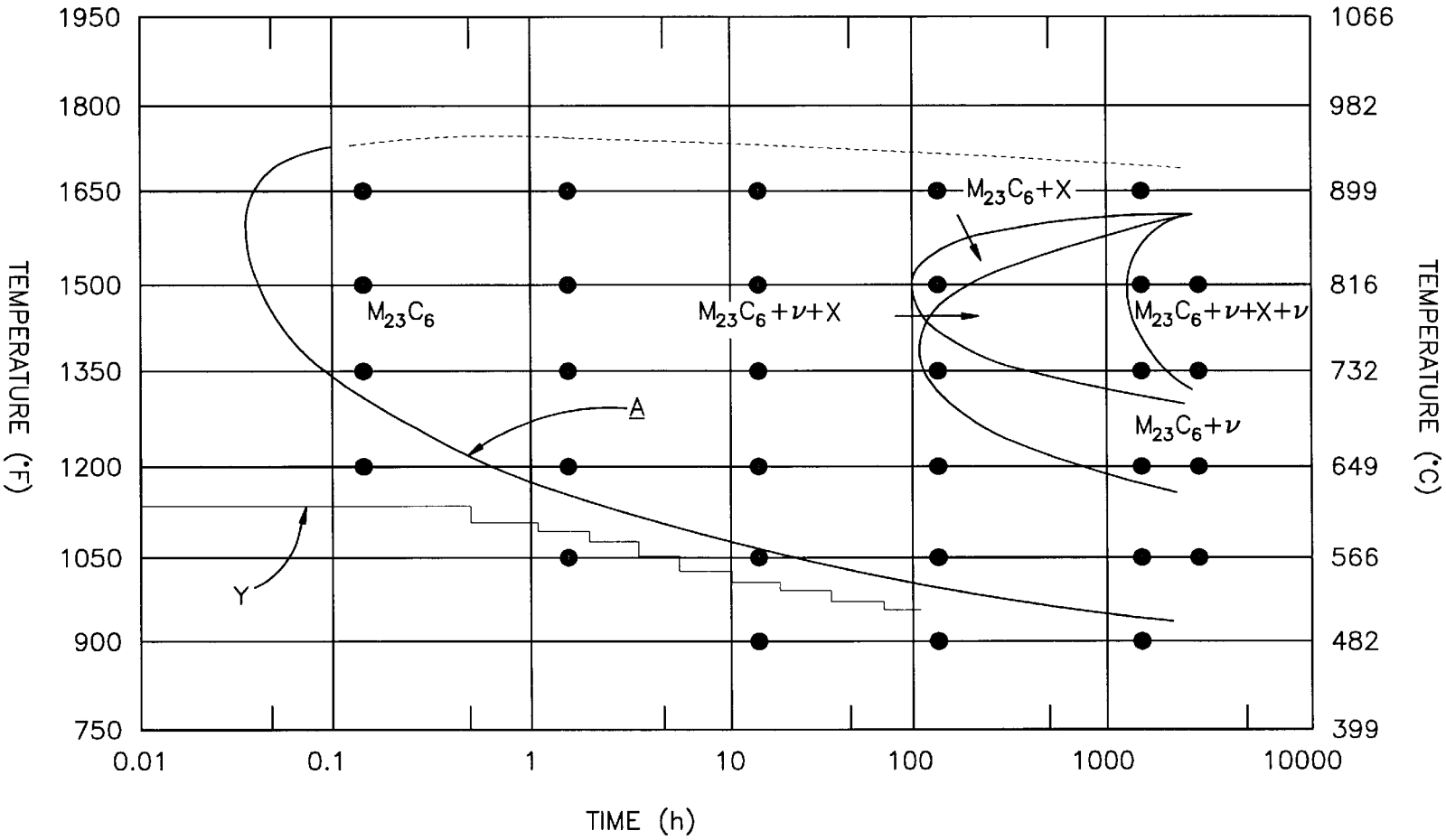
FIG. 3 is a view similar to FIG. 2 illustrating another technique for carrying out low temperature carburization in accordance with the present invention.

Another embodiment of this aspect of the present invention is illustrated by Curve Y in FIG. 3. This embodiment is carried out in the same wave as described above, except that the carburization temperature is lowered in steps rather than continuously. Incremental reductions may be simpler in many instances, especially from an equipment standpoint. Because carburization processes can take a few to many hours, the number of increments can vary from as few as three to five to as many as 10, 15, 20, 25 or even more.

It should also be appreciated that the advantages of the present invention can be realized even if the initial carburization temperature is not maintained close to Curve A at the very early stages of carburization. FIGS. 1 to 3 show that at the very early stages of carburization, for example during the first hour, the slope of Curve A is relatively steep with the temperature where carbide precipitates begin to form dropping off rapidly. Accordingly, while the fastest carburization can be accomplished by keeping the instantaneous carburization temperature close to Curve A throughout the entire carburization process, practical considerations including equipment limitations may dictate that the initial portion of Curve A be disregarded in setting the initial carburization temperature during the initial operating phase of carburization. This is also illustrated in FIGS. 2 and 3, where it can be seen that the initial carburization temperature of Curves X and Y is set to be at least 50° F. below Curve A starting at the one-half hour mark, meaning that the first half hour of operation under Curve A has been disregarded. In the same way, the first 1, 2, 3, 5 or even 10, 15 or 20 hours of initial operation can be disregarded in setting the initial carburization temperature in accordance with this aspect of the present invention. In any event, it will be appreciated that an overall faster carburization rate can be achieved in accordance with the present invention by starting with a higher carburization temperature than used in the past so as to achieve a higher instantaneous rate of carburization and lowering this carburization temperature over the course of carburization to continue avoiding carbide precipitates throughout the carburization process.

In accordance with still another feature relating to this aspect of the invention, the instantaneous carburization temperature may be allowed to drop below the temperature range described above for some period of time during carburization without departing from the spirit and scope of the invention. For example, even if the instantaneous carburization temperature drops below this range for 5, 10 or even 20% of the time period over which carburization occurs the advantages of the present invention will be realized. Of course, the overall rate of carburization will decrease if carburization is carried out at these lower temperatures. Nonetheless, the advantage of a faster overall carburization rate will still be achieved so long as during a substantial portion of the time over which carburization occurs, the carburization temperature is maintained higher than the endpoint carburization temperature in the manner described above.

Carburization Gas

A variety of different carbon compounds can be used for supplying carbon to the workpiece to be carburized in conventional gas carburization. Examples are hydrocarbon gases such as methane, ethane and propane, oxygen-containing compounds such as carbon monoxide and carbon dioxide, and mixtures of these gases such as synthesis gas. See the above-noted Stickles article.

It is also well known in conventional gas carburization to include diluent gases in the carburization gas mixture. Diluent gases serve to decrease the concentration of the carbon-containing specie in the carburization gas, thereby preventing excessive deposition of elemental carbon on the workpiece surfaces. Examples of such diluent gases are nitrogen, hydrogen, and the inert gases such as argon.

In accordance with the present invention, any of these compounds and diluents used in formulating carburization gases in conventional gas carburization can also be used to prepare the carburization gas used in the present invention. A gas mixture which has found particular applicability in the present invention is composed of a mixture of carbon monoxide and nitrogen with the carbon dioxide content varying between 0.5 and 60%, more typically 1 to 50% or even 10 to 40%. Another gas mixture that is particularly useful in accordance with the present invention is composed of 0.5–60% volume carbon monoxide, 10–50% volume hydrogen, remainder nitrogen. These gases are typically used at about one atmosphere, although higher or lower pressures can be used if desired.

Adjustment of Carburization Gas

In accordance with another aspect of the present invention, the overall carburization rate of a low temperature carburization process is also enhanced by adjusting the concentration of the carbon-containing specie in the carburization gas. Like temperature, carbon concentration in conventional low temperature gas carburization is normally held constant to assure that excessive production of carbon and soot in the later stages of carburization is avoided. In accordance with this aspect of the invention, therefore, the concentration of carbon-containing compound or specie in the carburization gas is adjusted during carburization from an initial higher value to a lower final value.

The instantaneous rate of carburization in a low temperature gas carburization process, up to a saturation limit, also depends on the concentration of carbon specie in the carburizing gas. Accordingly, this aspect of the invention employs a higher carbon concentration at the beginning of carburization followed by a lowering of the carbon concentration during the carburization process. By this means, faster carburization is accomplished at early stages of carburization with sufficient carbon specie to avoid starving the greater demand for carbon at this time. Then, at later stages of the process, carburization is accomplished with less concentration of carbon specie so that formation of excess carbon and soot is avoided. The overall result is that less soot is formed on the product than if the carbon concentration had remained at its initial value throughout the carburization process and, in addition, a harder and more uniform case is obtained than if the carbon concentration had remained at its final value throughout the carburization process.

Accordingly, the present invention also contemplates a low temperature carburization process in which the concentration of the carburizing specie in the carburizing gas is lowered from an initial concentration to a final concentration during carburization so as to achieve faster carburization than possible for carburization carried out at the final concentration only.

The amount by which the concentration of the carburizing specie in the carburizing gas should be reduced in carrying out this aspect of the present invention can vary widely, and basically any reduction more than an insignificant amount will achieve the advantages of the present invention. Typically, the concentration of the carburizing specie will be reduced to less than about 75% of its initial value. Final concentration values less than about 50% of the initial value, more commonly less than 25% or even less than 10% are practical.

The manner by which the concentration of carbon-containing specie in the carburizing gas is reduced can also vary considerably. As in the case of temperature reduction, reduction in carbon concentration can occur continuously over the course of carburization, starting at the very beginning of carburization or starting after an initial period of operation (e.g. after 0.5, 1, 5 or 10 hours) has elapsed. More typically reduction in carbon concentration will occur in steps wherein the concentration of carburizing specie is lowered in increments at least 2, 5 or even 10 times or more between the initial and final concentrations. In this case as well, reduction in carbon concentration can occur shortly after carburization has begun or after a suitable delay period of 0.5. 1, 5 or 10 hours, for example.

It should also be appreciated that, as in the case of temperature reduction, low temperature carburization carried out with carbon concentration reduction can also be interrupted at an intermediate stage between initial operations at the higher carbon concentration and the later stages of carburization at the lower levels of carbon concentration. In particular, keeping the concentration of carbon in the carburizing gas above a certain level during the entire carburization process is not essential to achieving the advantages of the present invention, it being sufficient that over a substantial period of time from beginning to end of carburization the concentration of carbon decreases in the manner described above. As in the case of temperature reduction, however, the overall rate of carburization will decrease if the concentration of carbon is lowered significantly for any significant period of time during the carburization process.

As in the case of temperature reduction, lowering the carbon concentration of carburizing gas from an initial higher value to a lower value at the end of carburization enhances overall carburization process. In the case of lowering the carburization temperature, this enhancement is reflected in a faster carburization time. In the case of lowering the concentration of carbon in the carburizing gas, this enhancement is reflected in a harder case and/or less soot in the final product. In either case, improved results are achieved by suitable control of the carburization conditions.

It should also be appreciated that both aspects of the invention as described above-temperature reduction and carbon concentration reduction can be carried out at the same time in the same process. Both techniques accomplish the same objective of increasing the overall rate of carburization while minimizing risk of carbide precipitate formation by fostering a higher carburization rate during initial stages of carburization while avoiding conditions which favor precipitate formation at later stages of carburization. Therefore. both can be used together to provide a particularly effective means of speeding conventional low temperature carburization.

Reactivation

In accordance with still another aspect of the present invention, it has been found that the rate of low temperature carburization of stainless steel articles can be even further enhanced by subjecting the workpiece to an additional activation step before carburization is completed. As indicated above, stainless steels and other alloys forming a coherent coating of chromium oxide need to be activated before carburization so that the oxide coating becomes previous to the diffusion of carbon atoms therethrough. In conventional gas carburization processes, including conventional low temperature gas carburization processes, activation is carried out only once after the workpiece is placed in the carburization furnace, with the workpiece remaining, in the furnace after activation since the coherent oxide coating would reform if the workpiece were removed from the furnace.

In accordance with this aspect of the invention, however, it has been further found that the overall rate of carburization of a low temperature carburization process when practiced on a workpiece not contacted with the atmosphere after initial activation can be further enhanced by subjecting the workpiece to another activation procedure before carburization is completed. This reactivation seems to be more thorough than the initial activation, which may be due to the fact that some amount of carbon has already been diffused into the workpiece surfaces. In any event, reactivation results in formation of a hardened surface or case which is both more uniform and harder than that obtained without reactivation.

Reactivating the workpiece in accordance with this aspect of the invention can be done using any of the activating techniques described above. Activation using a hydrogen halide gas, particularly HCl, has been found to be particularly effective. Also, it is desirable to include a diluent gas such as nitrogen, argon, hydrogen, argon or other gas inert in the activating gas mixture in an amount such that the concentration of HCl or other activating gas is about 5 to 50, more typically 10 to 35 and especially about 15 to 300%. Also, reactivation is most conveniently carried out by lowering the workpiece temperature to a temperature at which carburization does not occur to any substantial degree, for example from 200° to 700° F., more typically 300°0 to 650° F., and especially 500° to 600°0 F. In addition, it is also desirable to suspend the flow of carbon-containing specie to the workpiece during reactivation to avoid waste. Other conditions of activation can be used, however, if desired.

Intermediate Purging

In accordance with still another aspect of the present invention, it has also been found that the quality of the case produced by gas carburizing a workpiece that has been activated by electroplating with iron can be improved by contacting the workpiece with an inert gas at 600° F. or less during an intermediate stage of the carburization process.

Any gas which is inert to the workpiece including its partially-formed hardened case can be used for this process. Examples are nitrogen, argon, hydrogen, argon or other inert gas.

Most gas carburization processes including the inventive process as described above are conveniently carried out at essentially atmospheric pressure with the carburizing gas being continuously supplied to the carburization furnace so as to prevent atmospheric air from entering the furnace. Intermediate purging as contemplated herein is most easily carried out by continuing the flow of diluent in the carburizing gas while terminating, the flow of the carburizing specie. Alternatively, all gas flows can be terminated after the furnace is filled with the inert gas. In any event, to achieve an enhanced case in accordance with this aspect of the invention, the temperature of the workpiece should be lowered to 600° F. or less during an intermediate stage of the carburization process and the atmosphere in contact with the workpiece changed to be inert, i.e. so that components which might react with the workpiece surfaces, including the carbon specie used for carburization, are eliminated. By proceeding in this manner, the hardened surface or case produced by the carburization process will be harder and more uniform.

Like the reactivation procedure described earlier, this purging procedure can be accomplished anytime during the carburization procedure although it will normally be accomplished after carburization is at least 10% complete, as measured by amount of carbon taken up by the workpiece surfaces, but before carburization is 80% complete Purging when carburization is between 35 and 65% complete is more typical. Also, purging will normally be done at 300° to 600° F. more typically 400° to 500° F. for 10 minutes to one hour, more typically 20 to 40.

EXAMPLES

In order to more thoroughly describe the present invention, the following working examples are provided:

Example 1

An AISI 316 stainless steel workpiece, after cleaning to remove organic residue, was activated by electroplating with a thin layer of iron.

The activated workpiece was dried and then carburized by contact with a carburizing gas composed of a continuously flowing mixture of CO and $N_2$ at a temperature between 980° and 880° F. The carburization process lasted approximately 168 hours. Over that period of time, the carburization temperature was reduced from 980° and 880° F. while the concentration of CO was reduced from 50% to 1.0% in accordance with the schedule in the following Table 1:

TABLE 1

| Run time hrs. | ½ | 1 | 2 | 4 | 7 | 12 | 18 | 42 | 66 | 114 | 168 |
|---|---|---|---|---|---|---|---|---|---|---|---|
| Retort T ° F. | 980.0 | 980.0 | 963.3 | 946.7 | 934.1 | 924.9 | 917.3 | 902.5 | 895.6 | 887.1 | 880.0 |
| CO % | 50.0 | 34.1 | 19.4 | 11.5 | 7.7 | 5.5 | 4.2 | 2.4 | 1.8 | 1.3 | 1.0 |

The workpiece so carburized was then cooled to room temperature and cleaned to produce a product having a hardened surface (i.e. a case) approximately 0.003 inch deep the case being essentially free of carbide precipitates.

Example 2

Example 1 was repeated except that the carburization temperature was maintained at a constant 880° F. until a hardened case free of carbide precipitates and approximately 0.003 inch deep was produced. In addition, the concentration of CO in the carburizing gas was maintained at 1.0% between 168 and 240 hours. Under these conditions 240 hours of operation were required to achieve a case of this thickness.

Example 3

An AISI 316 stainless steel workpiece, after cleaning to remove organic residue, was activated by contact with 20% HCl in $N_2$ at 550° F. for 60 minutes.

The activated workpiece was dried and then heated to 880° F. by contact with a continuously flowing carburizing gas composed of a mixture of CO, $H_2$ and $N_2$. Carburization lasted approximately 24 hours over which time the concentration of CO in the carburization gas was reduced from 50% to 1.0% at constant $H_2$ concentration in accordance with the schedule in the following Table 1:

TABLE 2

| | ½ | 1 | 2 | 4 | 7 | 12 | 18 | 24 |
|---|---|---|---|---|---|---|---|---|
| CO % | 50.0 | 35.4 | 25.0 | 17.7 | 13.4 | 10.2 | 8.3 | 7.2 |

The workpiece so carburized was then cooled to room temperature and cleaned to produce a product having a hardened surface (i.e. a case) approximately 0.00095 inch deep the case being essentially free of carbide precipitates and with minimized production of soot.

Example 4

Example 3 was repeated except that after two hours of carburization, the carburization process was interrupted by terminating the flow of CO and cooling the workpiece to 300° F. by continuous flow of $N_2$. Then, 20% HCl was added to the flowing gas for reactivating the workpiece surfaces, and the workpiece temperature was raised to 550° F. After 60 minutes at these conditions, carburization was resumed. It was found that a case approximately 0.00105 inch deep was achieved in the same amount of time and moreover that the case which formed was more uniform in depth than the case formed in Example 3.

Although only a few embodiments of the present invention have been described above, it should be appreciated that many modifications can be made without departing from the spirit and scope of the invention. All such modifications are intended to by included within the scope of the present invention, which is to be limited only by the following claims.

We claim:

1. A process for case hardening a workpiece by gas carburization in which the workpiece is contacted with a carburizing gas at an elevated carburization temperature to cause carbon to diffuse into the workpiece surfaces thereby forming a hardened case of predetermined thickness without formation of carbide precipitates, wherein the instantaneous rate of carburization is reduced during carburization so as to foster rapid carburization during an earlier stage of carburization while avoiding formation of carbide precipitates at a later stage of carburization.

2. The process of claim 1, wherein the workpiece is made from stainless steel.

3. The process of claim 2, wherein the workpiece is made from alloy AISI 316, 316L, 317 or 317L stainless steel.

4. The process of claim 1, wherein the carburization gas contains an oxygen-containing gas.

5. The process of claim 4, wherein the oxygen-containing gas is carbon monoxide.

6. A process for low temperature gas carburizing a workpiece containing iron, nickel or both comprising contacting the workpiece with a carburizing gas at an elevated carburizing temperature sufficient to promote diffusion of carbon into the surfaces of the article but insufficient to promote substantial formation of carbide precipitates in the article surfaces, wherein the carburizing temperature is lowered from an initial carburizing temperature to a final carburizing temperature so as to achieve faster carburization than possible for carburization carried out at the final carburizing temperature only.

7. The process of claim 6, wherein the carburizing temperature is lowered in increments at least twice between its initial value and its final value.

8. The process of claim 7, wherein the carburizing temperature is lowered in increments at least five times between the initial and final carburization temperatures.

9. The process of claim 6, wherein for at least 80% of the time beginning 1 hour after carburization has begun and ending when carburization is substantially completed, the instantaneous carburizing temperature is maintained within 200° F. of the temperature at which substantial formation of carbide precipitates will begin.

10. The process of claim 9, wherein for at least 80% of the time beginning 1 hour after carburization has begun and ending when carburization is substantially completed, the instantaneous carburizing temperature is maintained within 100° F. of the temperature at which substantial formation of carbide precipitates will begin.

11. The process of claim 9, wherein the workpiece is made from stainless steel.

12. The process of claim 11, wherein the workpiece is made only from alloy AISI 316, 316L, 317 or 317L stainless steel.

13. The process of claim 6, wherein for at least 95% of the time beginning 1 hour after carburization has begun and ending when carburization is substantially completed, the instantaneous carburizing temperature is maintained within 200° F. of the temperature at which substantial formation of carbide precipitates will begin.

14. The process of claim 13, wherein for at least 95% of the time beginning 1 hour after carburization has begun and ending when carburization is substantially completed, the instantaneous carburizing temperature is maintained within 100° F. of the temperature at which substantial formation of carbide precipitates will begin.

15. The process of claim 6, wherein the workpiece is made of stainless steel, and further wherein the surfaces of the workpiece to be hardened are activated prior to carburization to makes such surfaces previous to carbon atoms.

16. The process of claim 6, wherein after carburization is at least 5% complete as measured by the amount of carbon taken up by the workpiece surfaces but before carburization is 80% complete, carburization is interrupted and the workpiece is treated to enhance diffusion of carbon atoms into the workpiece surfaces.

17. The process of claim 16, wherein during the period beginning 1 hour after carburization has begun and ending when carburization is substantially completed, the only time the carburization temperature drops more than 100° F. below the temperature at which substantial formation of carbide precipitates will begin is during treatment of the workpiece to enhance diffusion of carbon atoms into the workpiece surfaces.

18. The process of claim 17, wherein the workpiece is made from stainless steel.

19. The process of claim 18, wherein the workpiece is made from alloy AISI 316, 316L, 317 or 317L stainless steel.

20. The process of claim 16, wherein the workpiece is made from stainless steel.

21. The process of claim 20, wherein the workpiece is made from alloy AISI 316, 316L, 317 or 317L stainless steel.

22. The process of claim 6, wherein the workpiece is made from stainless steel.

23. The process of claim 22, wherein the workpiece is made from alloy AISI 316, 316L, 317 or 317L stainless steel.

24. A process for low temperature gas carburizing a workpiece containing iron, nickel or both comprising contacting the workpiece with a carburizing gas at an elevated carburizing temperature sufficient to promote diffusion of carbon into the surfaces of the article but insufficient to promote substantial formation of carbide precipitates in the article surfaces, wherein the concentration of the carburizing specie in the carburizing gas is lowered from an initial concentration to a final concentration during carburization so as to achieve a harder case than possible for carburization carried out at the final concentration only and less soot generation than possible for carburization carried out at the initial concentration only.

25. The process of claim 24, wherein the concentration of carburizing specie is lowered in increments at least twice between the initial and final concentrations.

26. The process of claim 25, wherein the concentration of carburizing specie is lowered in increments at least five times between the initial and final concentrations.

27. The process of claim 24, wherein the final concentration of carburizing specie is less than 50% of the initial concentration of carburizing specie.

28. The process of claim 27, wherein the final concentration of carburizing specie is less than 25% of the initial concentration of carburizing specie.

29. The process of claim 28, wherein the final concentration of carburizing specie is less than 10% of the initial concentration of carburizing specie.

30. The process of claim 27, wherein the workpiece is made from stainless steel.

31. The process of claim 30, wherein the workpiece is made from alloy AISI 316, 316L, 317 or 317L stainless steel.

32. The process of claim 24, wherein the workpiece is made of stainless steel and further wherein the surfaces of the workpiece to be hardened are activated prior to carburization to makes such surfaces previous to carbon atoms.

33. The process of claim 32, wherein the carburization gas contains an oxygen-containing gas.

34. The process of claim 33, wherein the oxygen-containing gas is carbon monoxide.

35. The process of claim 24, wherein after carburization is at least 10% complete as measured by the amount of carbon taken up by the workpiece surfaces but before carburization is 80% complete, carburization is interrupted and the workpiece is treated to enhance diffusion of carbon atoms into the workpiece surfaces.

36. The process of claim 35, wherein during the period beginning 1 hour after carburization has begun and ending when carburization is substantially completed, the only time the carburization temperature drops more than 100° F. below the temperature at which substantial formation of carbide precipitates will begin is during treatment of the workpiece to enhance diffusion of carbon atoms into the workpiece surfaces.

37. The process of claim 35, wherein the workpiece is made from stainless steel.

38. The process of claim 37, wherein the workpiece is made from alloy AISI 316, 316L, 317 or 317L stainless steel.

39. The process of claim 24, wherein the workpiece is made from stainless steel.

40. The process of claim 39, wherein the workpiece is made from alloy AISI 316, 316L, 317 or 317L stainless steel.

41. The process of claim 24, wherein the carburization gas contains an oxygen-containing gas.

42. The process of claim 41, wherein the oxygen-containing gas is carbon monoxide.

43. A process for case hardening a workpiece by gas carburization in which the workpiece is contacted with a carburizing gas at an elevated carburization temperature to cause carbon to diffuse into the workpiece surfaces thereby forming a hardened case of predetermined thickness without formation of carbide precipitates, wherein after carburization has started but before carburization is completed carburization is interrupted and the workpiece is treated to enhance diffusion of carbon into the workpiece surfaces.

44. The process of claim 43, wherein the workpiece is made from stainless steel.

45. The process of claim 44, wherein the workpiece is made from alloy AISI 316, 316L, 317 or 317L stainless steel.

46. A process for low temperature gas carburizing a stainless steel workpiece comprising activating the surfaces of the workpiece to be carburized to make these surfaces previous to carbon atoms and then contacting the workpiece with a carburizing gas at an elevated carburizing temperature sufficient to promote diffusion of carbon into the surfaces of the article but insufficient to promote substantial formation of carbide precipitates in the article surfaces, wherein after carburization is at least 10% complete as measured by the amount of carbon taken up by the workpiece surfaces but before carburization is 80% complete, carburization is interrupted and the workpiece is reactivated to enhance diffusion of carbon atoms into the workpiece surfaces.

47. The process of claim 22, wherein after carburization is at least 35% complete but before carburization is 65% complete, carburization is interrupted and the workpiece is reactivated to enhance diffusion of carbon atoms into the workpiece surfaces.

48. The process of claim 47, wherein the workpiece is made from stainless steel.

49. The process of claim 48, wherein the workpiece is made from alloy AISI 316, 316L, 317 or 317L stainless steel.

50. The process of claim 46, wherein during the period beginning 1 hour after carburization has begun and ending when carburization is substantially completed, the only time the carburization temperature drops more than 100° F. below the temperature at which substantial formation of carbide precipitates will begin is during reactivation of the workpiece.

51. The process of claim 43, wherein the workpiece is made from stainless steel.

52. The process of claim 51, wherein the workpiece is made from alloy AISI 316, 316L, 317 or 317L stainless steel.

53. The process of claim 46, wherein the carburization gas contains an oxygen-containing gas.

54. The process of claim 53, wherein the oxygen-containing gas is carbon monoxide.

55. A process for case hardening a workpiece by gas carburization in which a workpiece electroplated with iron is contacted with a carburizing gas at an elevated carburization temperature to cause carbon to diffuse into the workpiece surfaces thereby forming a hardened case of predetermined thickness, wherein after carburization has started but before carburization is completed carburization is interrupted and the workpiece is contacted with a purging gas consisting essentially of an inert gas at a purging temperature below 600° F. so that the case formed at the end of carburization is harder than the case that would have been formed without contact with the purging gas.

56. The process of claim 55, wherein the workpiece is made from stainless steel.

57. The process of claim 56, wherein the workpiece is made from alloy AISI 316, 316L, 317 or 317L stainless steel.

58. A process for case hardening a workpiece by gas carburization in which the workpiece is contacted with a carburizing gas at an elevated carburization temperature to cause carbon to diffuse into the workpiece surfaces thereby forming a hardened case of predetermined thickness without formation of carbide precipitates, wherein the instaneous rate of carburization is maintained at a higher level during earlier stages of carburization to thereby foster rapid carburization during these early states and then reduced to a lower level during later stags of carburization to allow formation of the hardened case to be completed without formation of carbide precipitates.

59. The process of claim 58, wherein the carburization gas contains an oxygen-containing gas.

60. The process of claim 59, wherein the oxygen-containing gas is carbon monoxide.

* * * * *